US011292569B2

(12) United States Patent
Blomdahl et al.

(10) Patent No.: US 11,292,569 B2
(45) Date of Patent: Apr. 5, 2022

(54) POWER TRANSMISSION DEVICE AND METHOD FOR AN OUTBOARD MOTOR

(71) Applicant: OXE Marine AB, Ängelholm (SE)

(72) Inventors: Andreas Blomdahl, Ängelholm (SE); Kristoffer Mårtensson, Härslöv (SE); Heinz Stålhammar, Halmstad (SE); Christer Flodman, Hjärnarp (SE); Fredrik Larsson, Eslöv (SE); Victor Ljungberg, Båstad (SE)

(73) Assignee: OXE Marine AB, Ängelholm (SE)

( * ) Notice: Subject to any disclaimer, the term of this patent is extended or adjusted under 35 U.S.C. 154(b) by 91 days.

(21) Appl. No.: 16/491,604

(22) PCT Filed: Mar. 7, 2017

(86) PCT No.: PCT/EP2017/055272
§ 371 (c)(1),
(2) Date: Sep. 6, 2019

(87) PCT Pub. No.: WO2018/162039
PCT Pub. Date: Sep. 13, 2018

(65) Prior Publication Data

US 2021/0129965 A1 May 6, 2021

(51) Int. Cl.
*B63H 23/20* (2006.01)
*B63H 20/20* (2006.01)
(Continued)

(52) U.S. Cl.
CPC ..... *B63H 20/20* (2013.01); *B63H 20/32* (2013.01); *B63H 23/30* (2013.01);
(Continued)

(58) Field of Classification Search
CPC ..... B63H 2020/005; B63H 2020/006; B63H 2023/0216; B63H 2023/0225
See application file for complete search history.

(56) References Cited

U.S. PATENT DOCUMENTS 4,408,994 A 10/1983 Blanchard
4,887,983 A * 12/1989 Bankstahl ..... B63H 5/10 440/57
(Continued)

FOREIGN PATENT DOCUMENTS

| | | |
|---|---|---|
| CN | 2548903 | 5/2003 |
| EP | 2653375 | 10/2013 |
| EP | 3168134 A1 | 5/2017 |

OTHER PUBLICATIONS

PCT International Search Report and Written Opinion for corresponding International Application No. PCT/EP2017/055272 dated Nov. 2, 2017.

*Primary Examiner* — Andrew Polay
(74) *Attorney, Agent, or Firm* — Renner, Otto, Boisselle & Sklar, LLP

(57) ABSTRACT

A power transmission device for an outboard motor, comprising a drive shaft, an endless loop flexible drive coupling and a propeller shaft, wherein the endless loop flexible drive coupling operatively connects said drive shaft to said propeller shaft for transferring output power from the drive shaft to the propeller shaft. The power transmission device comprises a first drive shaft, a second drive shaft, a first endless loop flexible drive coupling, a second endless loop flexible drive coupling, a first propeller shaft and a second propeller shaft, wherein the first propeller shaft is connected to the first drive shaft through the first endless loop flexible drive coupling to rotate the first propeller shaft in a first direction, and wherein the second propeller shaft is connected to the second drive shaft through the second endless loop flexible drive coupling to rotate the second propeller shaft in a second direction opposite to the first direction.

10 Claims, 7 Drawing Sheets

Figure 1:
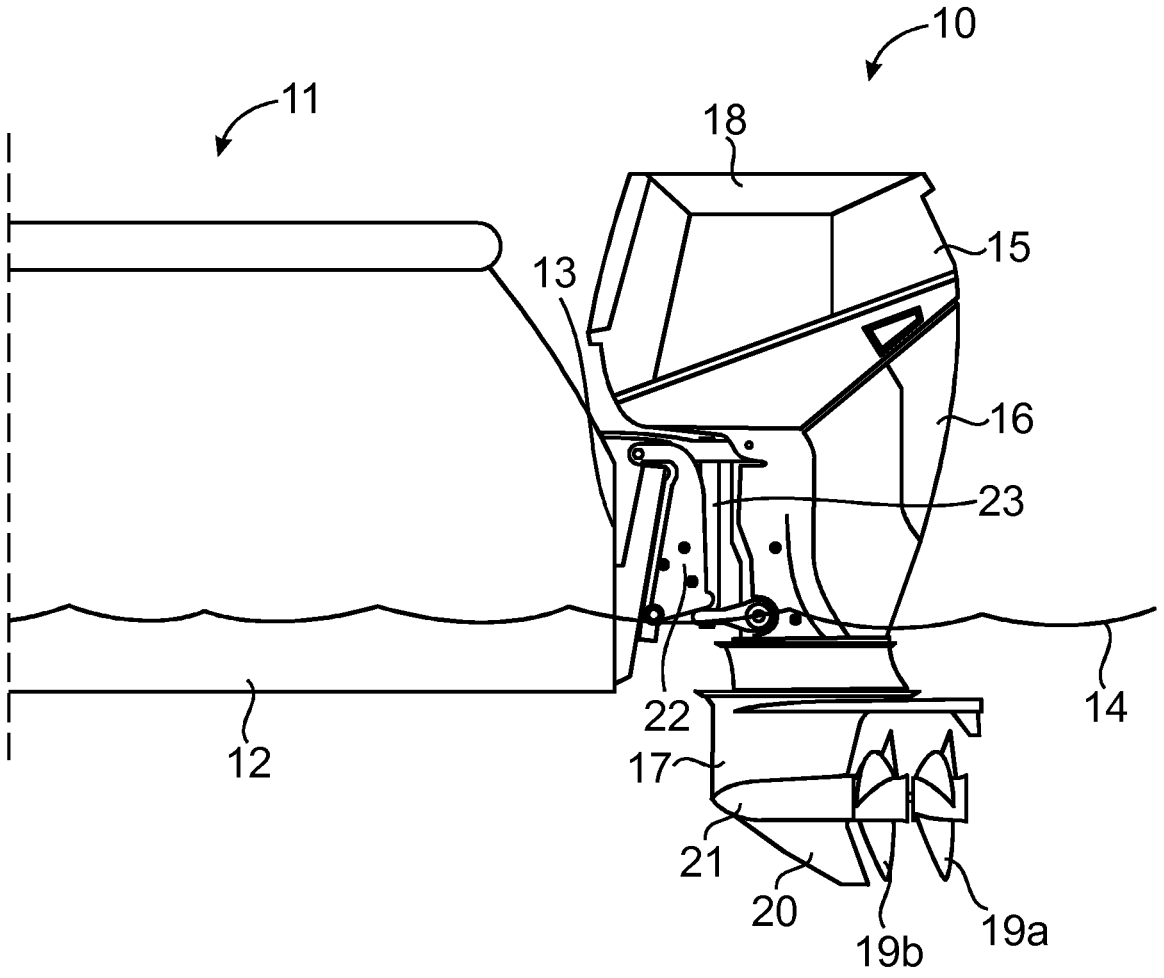

(51) Int. Cl.

| | |
|---|---|
| ***B63H 20/32*** | (2006.01) |
| *B63H 23/30* | (2006.01) |
| *B63H 20/00* | (2006.01) |
| *B63H 23/02* | (2006.01) |

(52) U.S. Cl.
CPC ..... *B63H 2020/006* (2013.01); *B63H 2023/0216* (2013.01); *B63H 2023/0283* (2013.01)

(56) References Cited

U.S. PATENT DOCUMENTS

| | | | | |
|---|---|---|---|---|
| 4,932,907 | A * | 6/1990 | Newman ..... | B63H 5/10 440/57 |
| 5,722,866 | A | 3/1998 | Brandt | |
| 5,961,358 | A | 10/1999 | Hardesty et al. | |
| 2004/0157510 | A1 | 8/2004 | Jordan | |
| 2015/0353177 | A1 | 12/2015 | Flodman et al. | |
| 2016/0059949 | A1 | 3/2016 | Rebele et al. | |

* cited by examiner

POWER TRANSMISSION DEVICE AND METHOD FOR AN OUTBOARD MOTOR

This application is a national phase of International Application No. PCT/EP2017/055272 filed Mar. 7, 2017 and published in the English language, which is hereby incorporated herein by reference in its entirety.

FIELD OF THE INVENTION

The present invention relates to a power transmission device and method for an outboard motor. More specifically the present invention relates to a power transmission device comprising a drive shaft, an endless loop flexible drive coupling and a propeller shaft, wherein the endless loop flexible drive coupling operatively connects said drive shaft to said propeller shaft for transferring output power from the drive shaft to the propeller shaft. The present invention also relates to an outboard motor having an engine and such a power transmission device.

Outboard motors are self-contained propulsion and steering devices for watercrafts, such as boats, and are arranged to be fastened to the outside of a transom of a boat. One type of such watercrafts is boats that are designed to plane during operation, wherein the propeller shaft is arranged substantially horizontally and below a hull of the watercraft during operation. The present invention also relates to a watercraft with such an outboard motor.

PRIOR ART

Outboard motors are common for propulsion of watercrafts, such as boats. They have a powerhead with an engine, a midsection and a lower unit with a propeller connected to a propeller shaft. A power transmission device is arranged for transferring output power from the engine to the propeller shaft. Further, a mounting bracket for mounting to the transom of the boat is common. A plurality of outboard motors for boats are disclosed in the prior art. One type of such prior art outboard motors comprises an engine having a horizontal crankshaft for output torque from the engine. According to the prior art torque is transferred from the crankshaft to a propeller shaft through pinions, a gearbox, chains, a belt or similar.

However, it is desirable to improve output torque, efficiency, speed, acceleration and/or fuel consumption of such outboard motors.

Hence, one problem of such prior art outboard motors is that the efficiency is low.

BRIEF DESCRIPTION OF THE INVENTION

One object of the present invention is to provide an efficient and reliable power transmission for an outboard motor. Further, an outboard motor comprising the power transmission device according to the invention can operate in an efficient manner to obtain straight tracking, faster acceleration and a favorable fuel to power ratio.

The present invention relates to a power transmission device for an outboard motor, comprising a drive shaft, an endless loop flexible drive coupling and a propeller shaft, wherein the endless loop flexible drive coupling operatively connects said drive shaft to said propeller shaft for transferring output power from the drive shaft to the propeller shaft, characterised in that the device comprises a first drive shaft, a second drive shaft, a first endless loop flexible drive coupling, a second endless loop flexible drive coupling, a first propeller shaft and a second propeller shaft, wherein the first propeller shaft is connected to the first drive shaft through the first endless loop flexible drive coupling to rotate the first propeller shaft in a first direction, and wherein the second propeller shaft is connected to the second drive shaft through the second endless loop flexible drive coupling to rotate the second propeller shaft in a second direction opposite to the first direction. The present invention is also related to an outboard motor having such a power transmission device, an engine and first and second propellers. Hence, the present invention results in efficient power transmission for an outboard motor and dual counter-rotating propellers of said outboard motor. The structure of the power transmission device, including the first and second endless loop flexible drive couplings, such as toothed belts, and the counter-rotating first and second propeller shafts result in the possibility of high torque power transfer and favorable grip in the water by means of the first and second propellers of the outboard motor, which also improves acceleration. Further, the outboard motor results in straight tracking of a watercraft and reduces lateral forces also when a plurality of outboard motors are used on a single watercraft. The present invention results in the possibility to efficiently transfer torque from high power diesel engines, such as engines developing up to 100, 200, 500, 1000 or more horsepowers, wherein 1 horsepower (hp) corresponds to approximately 0.74 kW. The disclosed power transmission device can allow for fully scalable torque transfer capability without affecting hydrodynamics. Further, the belt drive of the disclosed outboard motor result in a simple and reliable power transmission with few parts, resulting in an outboard motor with simplified maintenance.

The propeller shafts can be concentric. Further, the second drive shaft can be arranged in parallel to the first drive shaft. The second drive shaft can be arranged concentric to the first drive shaft or can be displaced vertically to the first drive shaft. The first and second drive shafts can be arranged in a common vertical plane. Hence, the first and second belts can be parallel and generally arranged in a common vertical plane when the outboard motor is mounted on the watercraft, which results in efficient hydrodynamics and efficient power transfer.

The second drive shaft can be connected to the first drive shaft through gears for efficient power transfer and for rotating the second drive shaft in the opposite direction. Alternatively, the first and second drive shafts can be connected to the engine crankshaft through a gearbox, wherein the second drive shaft can be rotated in the opposite direction and the rotational direction of both the first and second drive shafts can be reversed to drive the first and second drive shafts in reverse by engine power. Hence, a reliable and efficient power transfer is provided, and according to one embodiment also reversibly for efficient backwards travel of the watercraft or reduction of forward speed.

Disclosed is also a method for power transmission of an outboard motor, comprising the steps of a) transferring rotational power from an engine crankshaft to a first drive shaft, b) transferring rotational power from the crankshaft to a second drive shaft, c) rotating the first drive shaft in a first direction and the second drive shaft in a second direction opposite to the first direction, d) transferring the rotational power from the first drive shaft to a first propeller shaft through a first endless loop flexible drive coupling, e) transferring the rotational power from the second drive shaft to a second propeller shaft, arranged concentric with the first propeller shaft, through a second endless loop flexible drive coupling, and thereby rotate the first and second propeller shafts in opposite directions.

Further characteristics and advantages of the present invention will become apparent from the description of the embodiments below, the appended drawings and the dependent claims.

SHORT DESCRIPTION OF THE DRAWINGS

Figure 2:
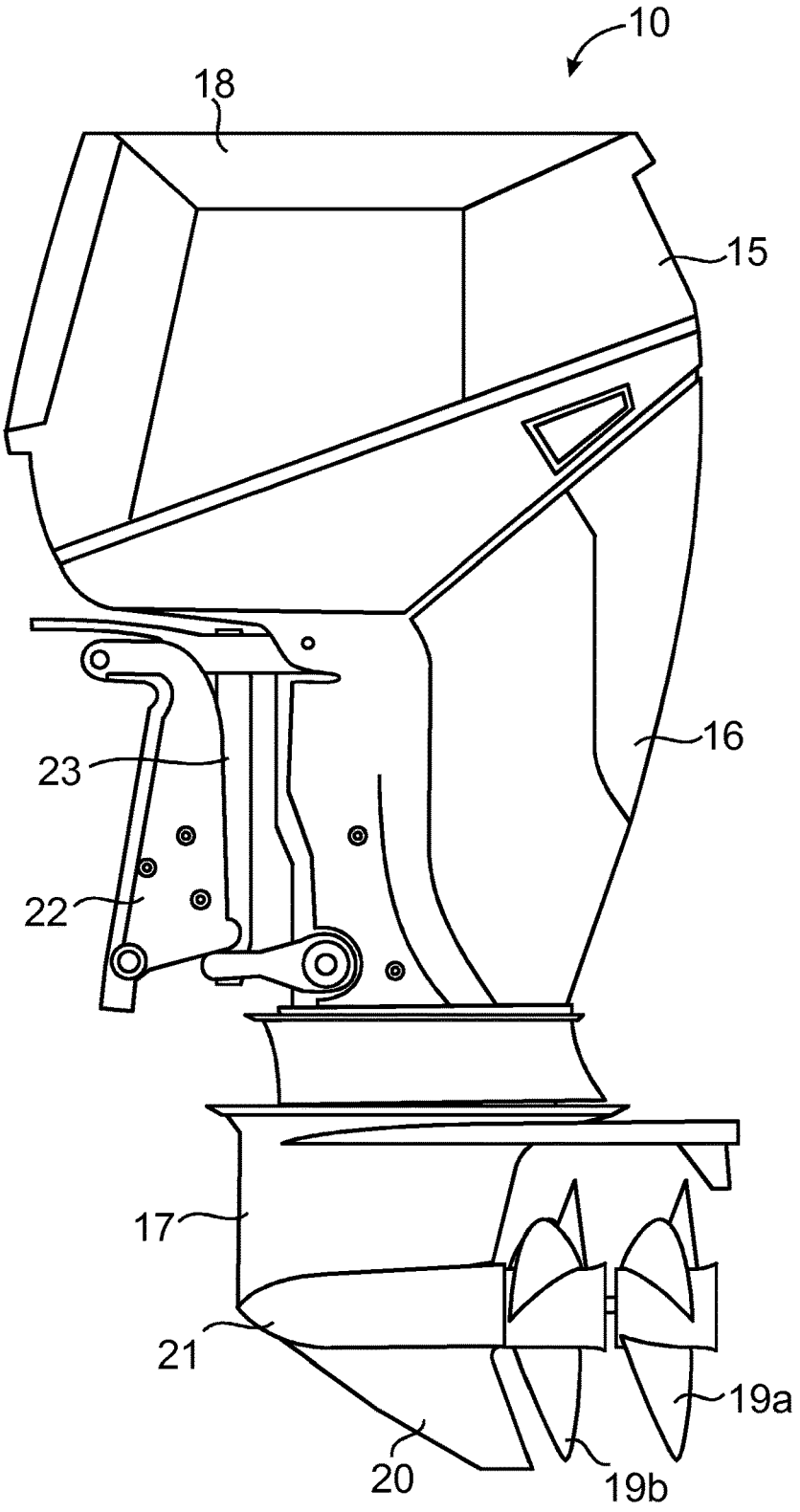
Figure 3:
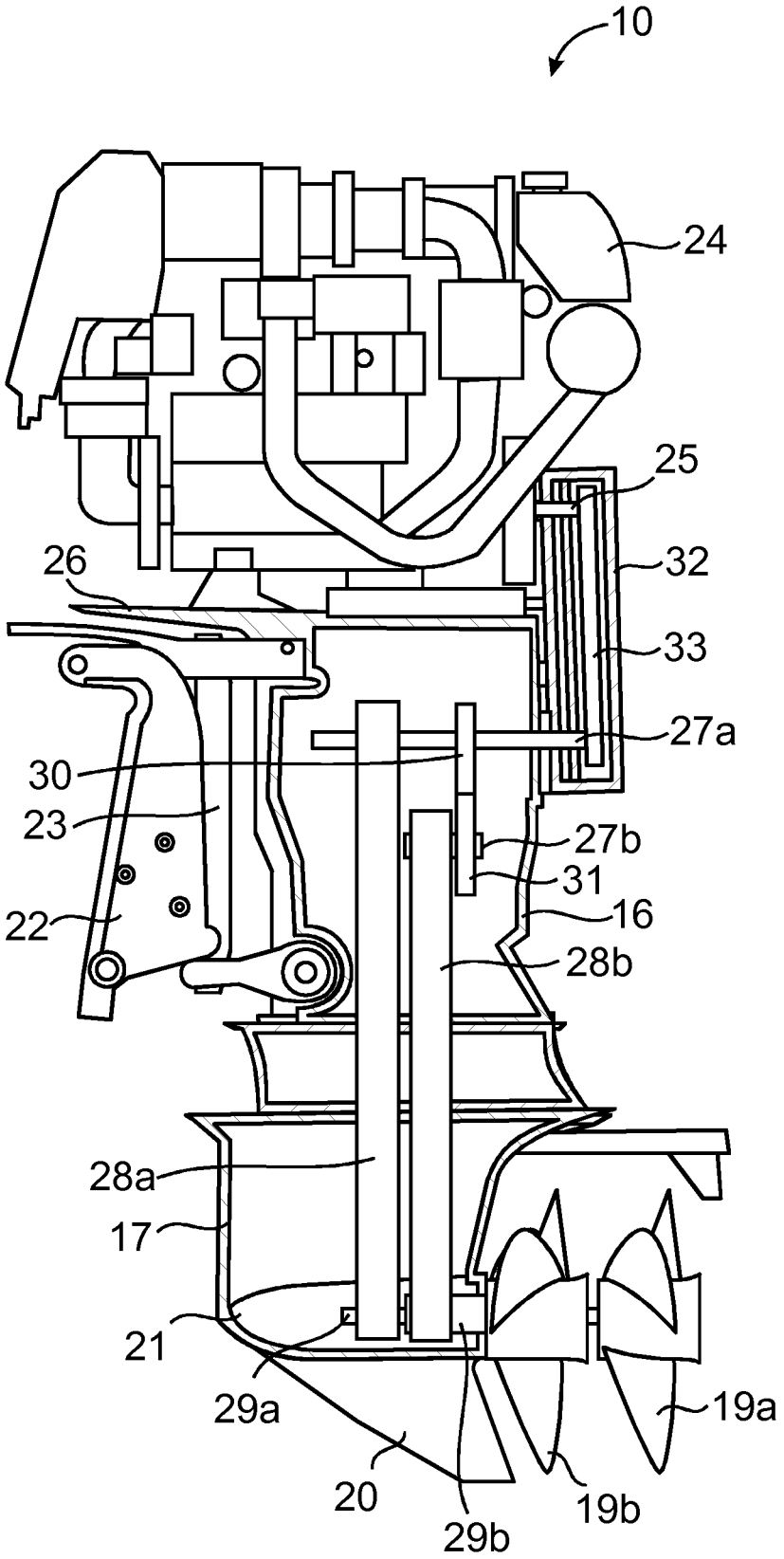
Figure 4:
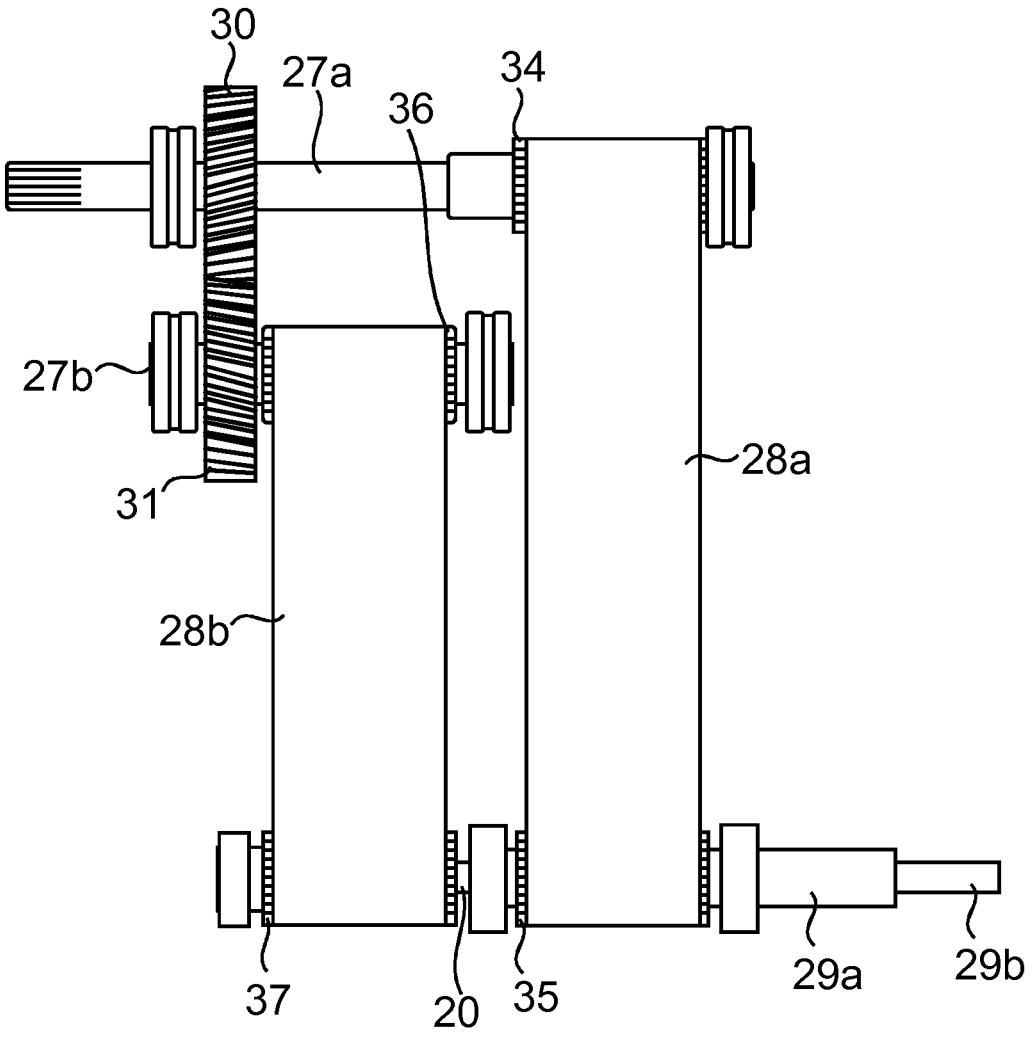
Figure 5:
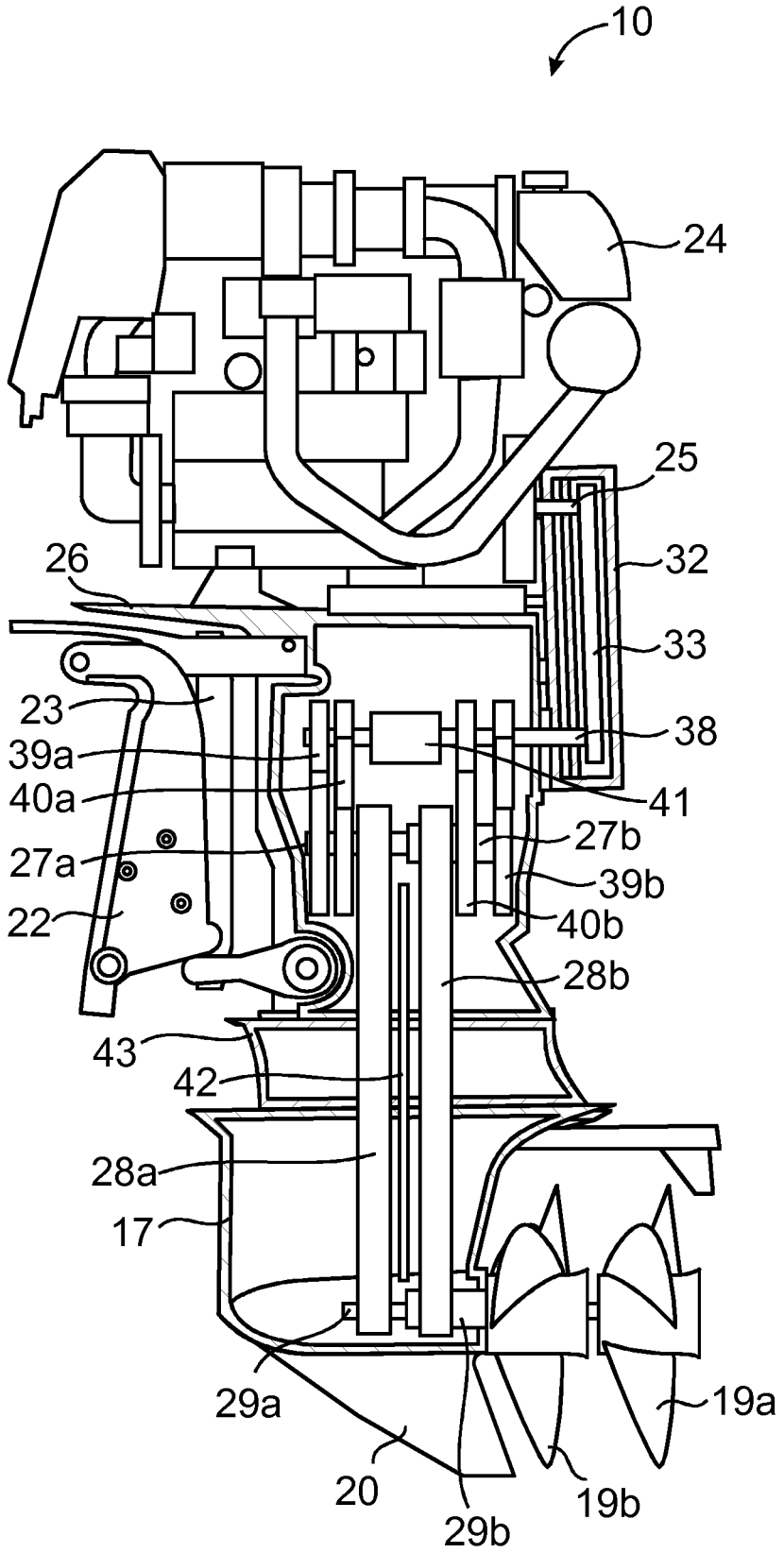
Figure 6:
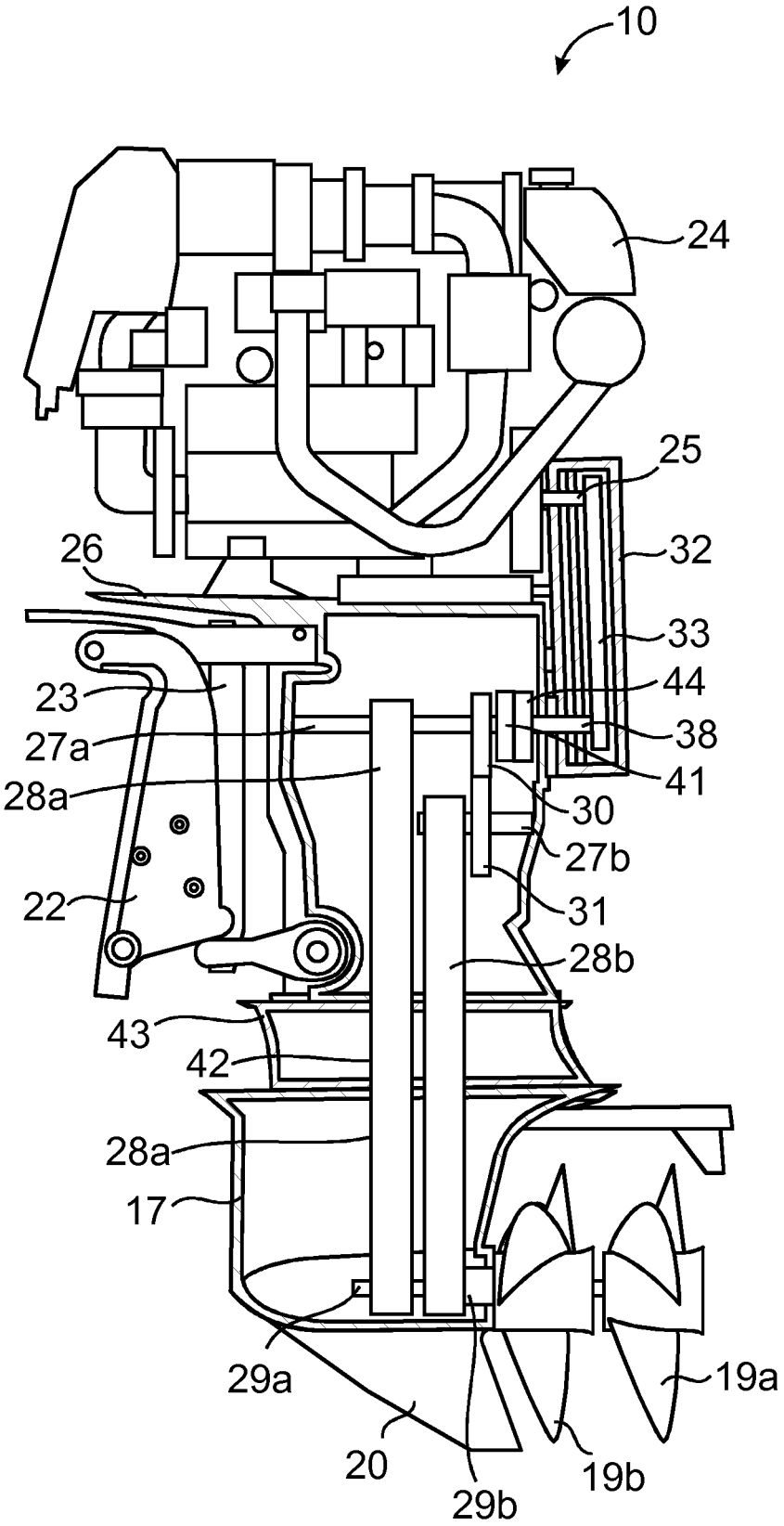
Figure 7:
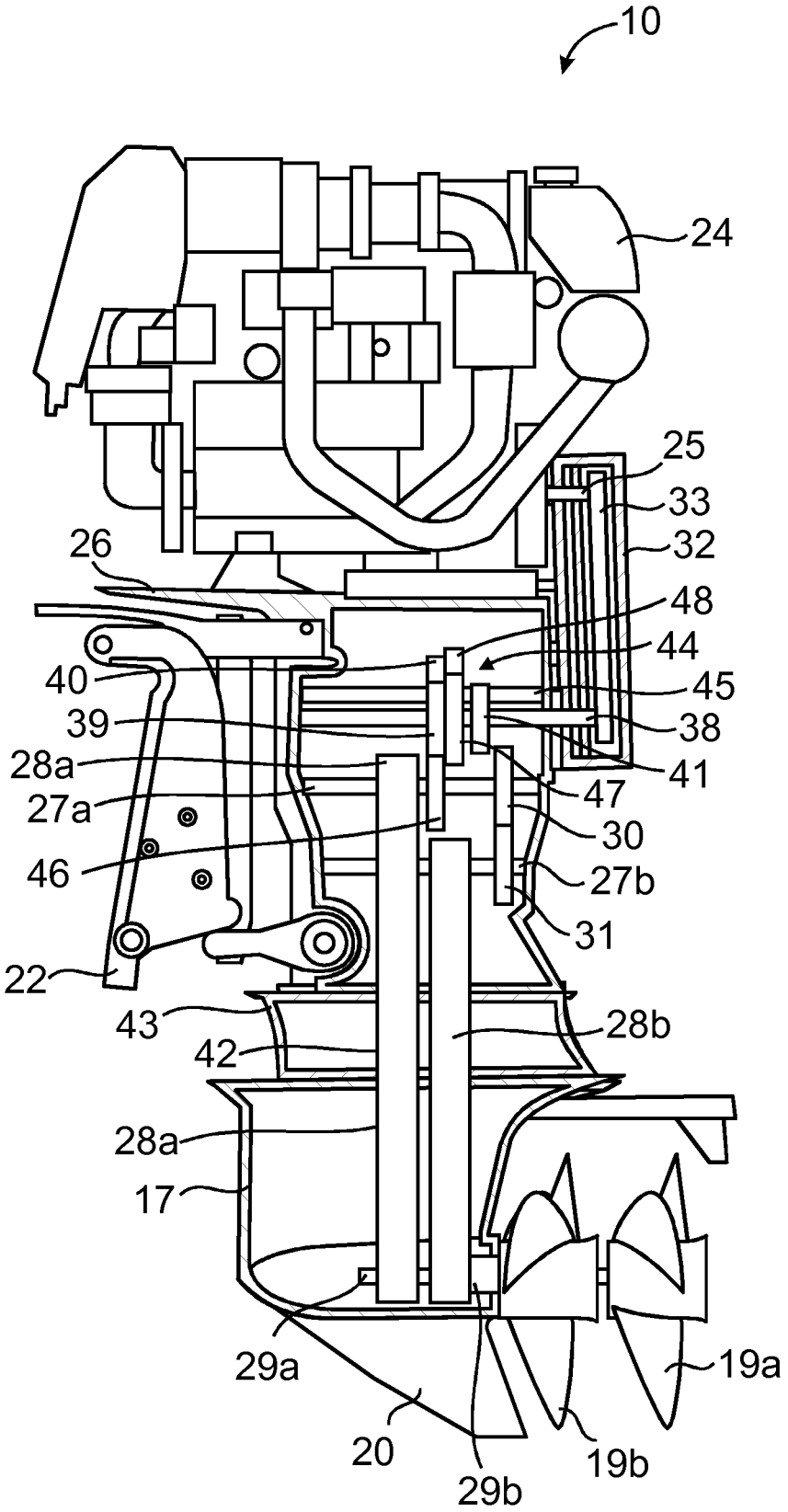

The invention will now be described in more detail with the aid of exemplary embodiments and with reference to the accompanying drawings, in which FIG. 1 is a schematic side view of a part of a watercraft with an outboard motor according to one embodiment, FIG. 2 is a schematic side view of the outboard motor of FIG. 1, FIG. 3 is a schematic and partial section view of the outboard motor, wherein an engine housing has been removed and a drive housing is illustrated in section to disclose the power transmission device according to one embodiment, FIG. 4 is a schematic side view of the power transmission device according to one embodiment, FIG. 5 is a schematic and partial section view of the outboard motor, wherein an engine housing has been removed and a drive housing is illustrated in section to disclose the power transmission device according to one alternative embodiment, FIG. 6 is a schematic and partial section view of the outboard motor, wherein an engine housing has been removed and a drive housing is illustrated in section to disclose the power transmission device according to another alternative embodiment, FIG. 7 is a schematic and partial section view of the outboard motor, wherein an engine housing has been removed and a drive housing is illustrated in section to disclose the power transmission device according to yet another alternative embodiment.

THE INVENTION

With reference to FIG. 1 an outboard motor 10 for a watercraft 11, such as a boat, is illustrated according to one embodiment of the invention. The outboard motor 10 is a self-contained marine propulsion and steering device for propulsion and steering of the watercraft 11. In FIG. 1 a rear part of the watercraft 11 is illustrated. The watercraft 11 comprises a hull 12 and a transom 13. For example, a lower part of the hull 12 is arranged to be below a waterline 14 when the watercraft 11 is in water and the watercraft 11 not is propelled, wherein an upper part of the hull is arranged to be above the waterline 14. For example, the watercraft 11 is arranged to plane during operation at higher speed, wherein the hull 12 is arranged with a planing hull form.

With reference also to FIG. 2 the outboard motor 10 comprises a power head 15, a midsection 16 and a lower unit 17. The power head 15 includes an engine and an engine housing 18, such as a cowling. The lower unit 17 includes a first propeller 19*a* and a second propeller 19*b*. For example, the lower unit 17 also includes a skeg 20 and other conventional parts, such as a torpedo-shaped part 21. The midsection 16 is formed as a leg connecting the power head 15 and the lower unit 17. Hence, the outboard motor 10 is arranged to be connected to the hull 12 of the watercraft 11, so that the outboard motor 10, or at least a major part thereof, is arranged outside the hull 12. The midsection 16 is arranged outside the transom 13 and the lower unit 17 with the propellers 19*a*, 19*b* is arranged outside and below the hull 12. When the outboard motor 10 is operated the propellers 19*a*, 19*b* are arranged below the water line 14 and also below the hull 12. For example, the lower unit 17 is arranged below the hull 12 during normal operation of the outboard motor 10. Hence, the outboard motor 10 is arranged to project a distance into the water when operated, so that the propellers 19*a*, 19*b*, the lower unit 17 and optionally a part of the midsection 16 are immersed in the water, so that the water line 14 is arranged above the propellers 19*a*, 19*b* and above the lower unit 17. Hence, the lower unit 17 is formed for efficient hydrodynamics. For example, the outboard 10 is arranged for a planing watercraft 11. The propellers 19*a*, 19*b* are arranged for counter-rotating, wherein the propellers 19*a*, 19*b* are arranged to rotate in opposite directions in relation to each other for propelling the watercraft. Hence, one of the first and second propellers 19*a*, 19*b* is a right-handed propeller, which rotates clockwise as viewed from the stern when propelling the watercraft forward, wherein the other is a left-handed propeller, which rotates counter-clockwise as viewed from the stern when propelling the watercraft forward.

For example, the outboard motor 10 comprises conventional fastening means for fastening the outboard motor 10 to the stern of the hull 12, such as the transom 13. The fastening means is, for example, arranged as a conventional mounting bracket 22. For example, the mounting bracket 22 comprises or is provided with a trim/tilt system, such as a hydraulic or electric trim/tilt system. For example, the trim/tilt system is conventional. Hence, the outboard motor 10 comprises a laterally extending trim axis, such as a horizontal trim axis. The outboard motor 10 comprises a steering axis 23, such as a vertical or substantially vertical steering axis (depending on trim). The entire outboard motor 10, except for the mounting bracket 22, is turned around the steering axis 23 for steering the watercraft 11. Hence, the power head 15, the midsection 16 and the lower unit 17 are pivotable around the steering axis 23. For example, the power head 15, the midsection 16 and the lower unit 17 are arranged in fixed positions in relation to each other and are turned as one unit around the steering axis 23.

With reference to FIG. 3 an outboard motor 10 according to one embodiment is illustrated schematically, wherein the engine housing 18 has been removed and the outboard motor 10 is illustrated partially in section so as to disclose schematically some of the parts arranged therein. As illustrated in FIG. 3 the outboard motor 10 comprises an engine 24, the first and second propellers 19*a*, 19*b* and a power transmission device for transferring output power originating from the engine 24 to the propellers 19*a*, 19*b*.

The engine 24 comprises a crankshaft 25 for output power in the form of rotational power, also called torque herein. For example, the engine 24 is an internal combustion engine, such as a diesel engine. The outboard motor 10 of the present invention can handle a variety of output powers and can be arranged smaller or bigger as desired. However, the outboard motor 10 according to the described structure can handle high torque and still be hydrodynamic and efficient for use as an outboard motor 10. For example, the engine 24 is a high power engine able to develop at least 73.5 kW (100 horsepower, hp). For example, the engine 24 is a 100-1000 horsepower (hp) engine, such as a 200-500 hp engine. For example, the crankshaft 25 is horizontal or substantially horizontal when the outboard motor 10 is operated for propelling the watercraft. For example, the engine 24 is an automotive engine industrially produced, such as mass produced in series of at least thousands, for propelling an automobile, such as a car or a truck, and then adapted to marine applications. For example, the engine has a plurality of cylinders, such as 4, 6 or 8 cylinders. For example, the engine 24 is capable of outputting power at levels of 200 hp or 500 hp or above. For example, the engine 24 is turbocharged, intercooled and/or has a closed cooling system, optionally with electric starting. The engine 24 is mounted on an engine support structure 26. For example, the engine support structure 26 defines the top of the midsection 16.

According to one embodiment the engine 24 comprises a flywheel (not illustrated). As a general principle engines of this type comprises a flywheel. The flywheel is, e.g. mounted on the crankshaft 25. For example, the flywheel is arranged on an aft side of the engine 24. Alternatively, the flywheel is arranged on a forward side of the engine 24. According to one embodiment, the flywheel is provided with a vibration damper, such as a torsion oscillation damper, to reduce torsional vibrations in the structure. The vibration damper is, e.g. mounted on the flywheel.

The engine 24 can be a marinized automotive engine that provided quietness, effectiveness and high torque. For example, the engine has been redesigned to arrange all serve points on the front of the engine so that maintenance and service can be performed on the water, e.g. by a person standing on the boat. The engine can be a proven robust diesel engine mounted horizontally and marinized with a closed circuit coolant system. E.g. the engine 24 allows for high power alternator and cabin heat. E.g. the engine is a turbo charged diesel engine with high pressure direct fuel injection. E.g. the engine 24 has been converted for marine application by using separate systems for seawater, heat exchangers, intercooler and oil cooler and functionality that ensures that the engine, electrical system, fuel system and air intake will withstand marine conditions. For example, all service points are located at the front of the engine for easy access so service and service part replacement can be made directly from the boat by the users.

In the embodiment of FIG. 3 the power transmission device comprises a first drive shaft 27*a*, a second drive shaft 27*b*, a first endless loop flexible drive coupling, such as a first belt 28*a*, a second endless loop flexible drive coupling, such as a second belt 28*b*, a first propeller shaft 29*a* and a second propeller shaft 29*b*. Alternatively, the first and second endless loop flexible drive couplings are arranged as chains or similar. For example, the belts 28*a*, 28*b* are toothed belts interacting with corresponding teeth on the drive shafts 27*a*, 27*b* and the propeller shafts 29*a*, 29*b* or pulleys arranged thereon. The first propeller shaft 29*a* is arranged for rotating the first propeller 19*a*, wherein the second propeller shaft 19*b* is arranged for rotating the second propeller 19*b*. Hence, the first propeller 19*a* is connected to the first propeller shaft 29*a*, wherein the second propeller 19*b* is connected to the second propeller shaft 29*b*. The outboard motor 10 comprises the first and second propellers 19*a*, 19*b* in the form of dual counter-rotating propellers. The first propeller shaft 29*a* is connected to the first drive shaft 27*a* through the first belt 28*a* to rotate the first propeller shaft 29*a* in a first direction, such as clockwise. The second propeller shaft 29*b* is connected to the second drive shaft 27*b* through the second belt 28*b* to rotate the second propeller shaft 29*b* in a second direction opposite to the first direction, such as counter-clockwise.

For example, the first and second belts 28*a*, 28*b* are arranged in parallel or substantially in parallel. In the illustrated embodiment the first and second belts 28*a*, 28*b* extend along the midsection 16 and into the lower unit 17, wherein the first and second belts 28*a*, 28*b* extend vertically or substantially vertically when the outboard motor 10 is operated (depending on trim) to transfer power in the same direction. The belts 28*a*, 28*b* connect the drive shafts 27*a*, 27*b* and the propeller shafts 29*a*, 29*b* and transfers rotational power from the drive shafts 27*a*, 27*b* to the propeller shafts 29*a*, 29*b*. In the embodiment of FIG. 3 the first belt 28*a* is longer than the second belt 28*b*. In the illustrated embodiment the first and second belts 28*a*, 28*b* are arranged below the engine 24. Hence, the first drive shaft 27*a* is arranged below the crankshaft 25. For example, the first drive shaft 27*a* is arranged in parallel to or substantially in parallel to the crankshaft 25. In the embodiment of FIG. 3 the second drive shaft 27*b* is connected to the first drive shaft 27*a*, for example through first and second gears 30, 31, such as gear wheels or similar, so that the second drive shaft 27*b* is rotated in the opposite direction as the first drive shaft 27*a*. For example, the second drive shaft 27*b* is arranged below the first drive shaft 27*a*. For example, the second drive shaft 27*b* is arranged in parallel to or substantially in parallel to the first drive shaft 27*a*.

The first and second propeller shafts 29*a*, 29*b* are arranged in the form of dual propeller shafts. For example, the first and second propeller shafts 29*a*, 29*b* are concentric and arranged to rotate in opposite directions to rotate the first and second propellers 19*a*, 19*b* in opposite directions. In the embodiment of FIG. 3 the first propeller shaft 29*a* extends through the second propeller shaft 27*b* and through the second propeller 19*b* to the first propeller 19*a*. Hence, the first propeller shaft 27*a* is arranged with smaller diameter than the second propeller shaft 27*b*. Further, the first propeller shaft 27*a* is longer than the second propeller shaft 27*b*. The propeller shafts 29*a*, 29*b* are arranged in the torpedo-shaped part 21 of the lower unit 17.

For example, the propeller shafts 29*a*, 29*b*, the drive shafts 27*a*, 27*b* and the crankshaft 25 are arranged in parallel or substantially in parallel. For example, the propeller shafts 29*a*, 29*b*, the drive shafts 27*a*, 27*b* and the crankshaft 25 are arranged in a common plane, such as a common vertical plane when the outboard motor 10 is mounted on the watercraft 11. For example, the crankshaft 25, the drive shafts 27*a*, 27*b* and the propeller shafts 29*a*, 29*b* are arranged horizontally or substantially horizontally when the outboard motor 10 is in a non-tilted operational position for propelling the watercraft 11 and the trim is neutral.

In the illustrated embodiment the first drive shaft 27*a* is connected to the crankshaft 25 through a power transfer device 32. The power transfer device 32 is arranged for transferring rotational power from the crankshaft 25 to the first drive shaft 27*a*. Hence, the power transfer device 32 connects the crankshaft 25 with the first drive shaft 27*a* for transferring the output power from the crankshaft 25 to the first drive shaft 27*a*. The power transfer device 32 extends substantially perpendicular to the crankshaft 25 and is arranged for transferring rotational power in a direction substantially perpendicular to the crankshaft 25 and the first drive shaft 27*a* for transferring the rotational power from the crankshaft 25 to the first drive shaft 27*a* being arranged in parallel to and below the crankshaft 25. For example, the power transfer device 32 comprises an endless loop flexible drive coupling, such as a toothed belt 33 connecting the crankshaft 25 and the first drive shaft 27*a*. The crankshaft 25 and the first drive shaft 27*a* extend from a first side of the power transfer device 32. For example, one end of the crankshaft 25 and one end of the first drive shaft 27*a* are connected to the power transfer device 32. For example, the crankshaft 25 projects from an engine interior and away from the stern.

With reference to FIG. 4 the power transfer device according to one embodiment is illustrated schematically. The first and second belts 28*a*, 28*b* are arranged at suitable length for the outboard motor 10 and the dimensions of the power transfer device may not be representative in the drawing.

In the embodiment of FIG. 4 the second propeller shaft 29*b* extends through the first propeller shaft 29*a*. As illustrated in FIG. 4 the first drive shaft 27*a* is connected to the second drive shaft 27*b* through the first gear 30 and the second gear 31, wherein the second drive shaft 27*b* is driven by the first drive shaft 27*a* and is rotated in the opposite direction as the first drive shaft 27*a* by means of power from the first drive shaft 27*a*, which power originates from the crankshaft 25. The first drive shaft 27*a* is connected to the first belt 28*a* through a first drive shaft pulley 34 and to the first propeller shaft 29*a* through a first propeller shaft pulley 35. The second drive shaft 27*b* is connected to the second belt 28*b* through a second drive shaft pulley 36 and to the second propeller shaft 29*b* through a second propeller shaft pulley 37.

With reference to FIG. 5 the outboard motor 10 according to another embodiment is illustrated schematically without the engine housing 18 and partially in section. In the embodiment of FIG. 5 the outboard motor 10 comprises a gearbox to provide forward and reverse operation by means of power from the crankshaft 25. The gearbox includes a transmission drive shaft 38 connected to the crankshaft 25 through the power transfer device 32. For example, the toothed belt 33 of the power transfer device 32 is connected to the transmission drive shaft 38. The transmission drive shaft 38 is connected to the first and second drive shafts 27*a*, 27*b* for driving the first and second drive shafts 27*a*, 27*b* in opposite and reversible directions. For example, the gearbox is connected to the first and second drive shafts 27*a*, 27*b* in the form of dual drive shafts for driving the first and second belts 28*a*, 28*b*, respectively. The first and second drive shafts 27*a*, 27*b* are, e.g. concentric and arranged to rotate in opposite directions when torque is applied to them from the gearbox. For example, the first belt 28*a* is connected to the transmission drive shaft 38 through the first drive shaft 27*a*, wherein the second belt 28*b* is connected to the transmission drive shaft 38 through the second drive shaft 27*b*. For example, the gearbox comprises a first forward gear 39*a* and a first reverse gear 40*a* for driving the first drive shaft 27*a* in forward and reverse mode, respectively. Further, the gearbox comprises a second forward gear 39*b* and a second reverse gear 40*b* for driving the second drive shaft 27*b* in forward and reverse mode, respectively. The first forward gear 39*a* and the first reverse gear 40*a* are arranged to be selected to connect the transmission drive shaft 38 and the first drive shaft 27*a*, wherein the second forward gear 39*b* and the second reverse gear 40*b* are arranged to be selected to connect the transmission drive shaft 38 and the second drive shaft 27*b*.

According to one embodiment the outboard motor 10 also comprises a clutch 41, such as a hydraulic clutch, e.g. having a clutch housing with clutch discs connected to a hydraulic pump for the clutch 41. The clutch 41 is for example arranged as a dog clutch, automotive clutch or any other conventional or special type of clutch. For example, the clutch 41 is an automotive clutch industrially mass produced for automobiles, such as cars or trucks. For example, the gearbox and the clutch 41 are an electro-hydraulically operated system with two multi-plate clutch packages that allows for high torque and power transfer in both clockwise and counter-clockwise rotational directions. For example, the outboard motor 10 comprises Low Speed Control (LSC) that enables unprecedented control while mooring and low speed travel. LSC incorporates an electro-hydraulically operated clutch for smooth shifting between neutral, forward and reverse. LSC features sensor controlled propeller speed allowing for seamless control from zero to maximum rpm. According to one embodiment the gearbox is provided with a trolling function, wherein the clutch 41 is arranged to be able to slip so as to gradually reduce the rotational speed of the propellers 19*a*, 19*b* down to zero when the gearbox is in forward gears 39*a*, 39*b* or reverse gears 40*a*, 40*b*. For example, the clutch 41 comprises lamellas or a plate which can be slipped in both forward and reverse direction. For example, the clutch 41 comprises a plurality of individually lamellas which can be slipped. For example, the gearbox also comprises a neutral gear. For example, the gearbox is operable in forward, neutral and reverse gears. For example, the outboard motor 10 is arranged with the gearbox so that the output power is reversible, such as fully reversible, wherein the propellers 19*a*, 19*b* can be driven in a forward mode as well as a reverse mode by the engine 24. Hence, the rotational power from the engine 24 can be transferred to the propeller shafts 27*a*, 27*b* in either rotational direction for full engine power forward or full engine power in reverse. For example, the transmission drive shaft 38 is arranged in parallel to the crankshaft 25 and the propeller shafts 27*a*, 27*b*. For example, the transmission drive shaft 38 is arranged below the crankshaft 25. For example, the gearbox is arranged below the powerhead 15 and below the engine 24. Further, the gearbox is arranged above the waterline when the outboard motor 10 is propelling the watercraft 11.

For example, the first belt 28*a* and the second belt 28*b* are at least partially immersed in oil, wherein said oil is engaging said belts 28*a*, 28*b*. According to the illustrated embodiment the outboard motor 10 comprises a fence 42 arranged between the first belt 28*a* and the second belt 28*b* to reduce turbulence effects by the oil on the belts 28*a*, 28*b* during operation. The fence 42 extends along the belts 28*a*, 28*b*. For example, the fence 42 is arranged between the belts 28*a*, 28*b* in the lower unit 17, such as from a position above the propeller shafts 29*a*, 29*b* and towards the drive shafts 27*a*, 27*b*. For example, the fence 41 extends between the propeller shafts 29*a*, 29*b* and the second drive shaft 27*b*.

In the illustrated embodiment, the crankshaft 25 is arranged at the aft side of the engine 24, wherein the power transfer device 32 is connected to the aft side of the engine 24. In the embodiment of FIG. 5 the gearbox, the drive shafts 27*a*, 27*b*, the belts 28*a*, 28*b* and at least a part of the propeller shafts 29*a*, 29*b* are arranged below the engine 24.

The outboard motor 10 comprises a drive housing 43 for receiving the power transmission device including the drive shafts 27*a*, 27*b*, the belts 28*a*, 28*b* and the propeller shafts 29*a*, 29*b* and optionally also the gearbox. The outboard motor 10 also comprises the engine housing 16 for receiving the engine 24. The drive housing 43 provides functions of structural support, spacing and enclosing for the power transmission device and also supports the propellers 19*a*, 19*b* through the propeller shafts 29*a*, 29*b* being supported by the drive housing 43. For example, the drive housing 43 extends from the engine support structure 26 to the skeg 20. The drive housing 43 is connected to a structure for pinching legs of the first belt 28*a* together and for pinching legs of the second belt 28*b* together to reduce the cross-section of the outboard motor 10 below the water line 14 to reduce drag. For example, said structure comprises curved surfaces bending the path of travel of the belt legs of the power transmission device together. Further, according to one embodiment of the present invention the drive housing 43 is formed for containing oil for the power transmission device. Hence, the power transmission device is running in a partially oil filled housing. According to one embodiment of the invention the drive housing 43 is formed with a water inlet or a water pickup for cooling. The drive housing 43 is, for example, formed in a composite material or any other suitable material. According to one embodiment the gearbox, the drive shafts 27*a*, 27*b* and the belts 28*a*, 28*b* are positioned in the drive housing 43. The propeller shafts 29*a*, 29*b* are positioned partially in the drive housing 43, wherein outer portions thereof project out from the drive housing 43 for carrying the propellers 19*a*, 19*b*.

According to one embodiment the drive housing 43 is provided with an exhaust outlet (not illustrated) for exhaust gases from the engine 24. For example, the exhaust outlet is arranged above the propellers 19*a*, 19*b*. Alternatively or in addition, the centers of the propellers 19*a*, 19*b* are arranged with an exhaust outlet for a part of the exhaust gases or for all of it.

With reference to FIG. 6 another embodiment is illustrated wherein the outboard motor 10 includes a gearbox, which is simplified and denoted 44 in FIG. 6, with forward, reverse and neutral gears, so that the output power originating from the engine 24 is reversible. The first drive shaft 27*a* is connected to the transmission drive shaft 38 through the gearbox 44, wherein the second drive shaft 27*b* is connected to the first drive shaft 27*a* through the gears 30, 31. The outboard motor 10 also comprises the clutch 41. In the embodiment of FIG. 6 the first drive shaft 27*a* is aligned with the transmission drive shaft 38, wherein the second drive shaft 27*b* is arranged between the transmission drive shaft 38 and the propeller shafts 29*a*, 29*b* and in parallel to the first drive shaft 27*a*. However, according to one further embodiment, the first drive shaft 27*a* is arranged below the transmission drive shaft 38.

With reference to FIG. 7 yet another embodiment is illustrated wherein the outboard motor 10 includes the gearbox 44. The gearbox 44 comprises the forward gear 39 and the reverse gear 40 so that the output power originating from the engine 24 is reversible. For example, the gearbox 44 also comprises the neutral gear. The transmission drive shaft 38 transfers torque from the engine 24 to the first drive shaft 27*a* through the forward gear 39 or the reverse gear 40 to provide the possibility of reversing the rotational direction of the propeller shafts 29*a*, 29*b*. In the embodiment of FIG. 7 the transmission drive shaft 38 is connected to the crankshaft 25 through the power transfer device 32. For example, the transmission drive shaft 38 is connected to the crankshaft 25 through the toothed belt 33 of the power transfer device 32. The clutch 41 is arranged in a suitable position. For example, the clutch 41 is connected to the transmission drive shaft 38. In the illustrated embodiment the forward gear 39 is arranged on the transmission drive shaft 38, wherein the reverse gear 40 is arranged on another shaft, such as a transmission reverse shaft 45. For example, the transmission reverse shaft 45 is arranged in parallel to the transmission drive shaft 38. For example, the forward and reverse gears 39, 40 are gear wheels. The forward gear 39 and the reverse gear 40 are selectively engaged with the first drive shaft 27*a*, e.g. through a drive shaft gear wheel 46, to rotate the first drive shaft 27*a* in clockwise and counter-clockwise direction, respectively. For example, the transmission drive shaft 38 is connected to a device for transferring rotational power, such as a gear wheel 47 with axially unlockable locking function, which e.g. is mounted on the transmission drive shaft 38. For example, the gear wheel 47 is arranged to be selectively in locking engagement with the forward gear 39, wherein the forward gear 39 can be driven by the gear wheel 47 or can be operatively disengaged from it. For example, the gear wheel 47 is selectively connectable to the reverse gear 40 through the transmission reverse shaft 45 and through a reverse shaft gear wheel 48 with axially unlockable locking function. For example, the reverse shaft gear wheel 48 is arranged to be selectively in locking engagement with the reverse gear 40, wherein the reverse gear 40 can be driven by the gear wheel 47 through the reverse shaft gear wheel 48, or can be operatively disengaged from the reverse shaft gear wheel 48. Alternatively, the forward gear 39 and the gear wheel 47 are selectable to be in locking engagement with the transmission drive shaft 38. Hence, when in forward gear the transmission drive shaft 38 drives the forward gear 39, directly or through the gear wheel 47, which in turn drives the first drive shaft 27*a*, wherein no rotational power is transferred to the reverse gear 40 through the reverse shaft gear wheel 48 or the transmission reverse shaft 45. When in reverse gear the transmission drive shaft 38 drives the reverse gear 40, e.g. through the reverse shaft gear wheel 48, wherein the reverse gear 40 drives the first drive shaft 27*a*, e.g. through the drive shaft gear wheel 46, while no rotational power is transferred from the transmission drive shaft 38 or the gear wheel 47 to the forward gear 39. Hence, the first drive shaft 27*a* is connected to the transmission drive shaft 38 through the gearbox 44, wherein the second drive shaft 27*b* is connected to the first drive shaft 27*a* through the gears 30, 31 for rotating the second drive shaft 27*b* in the opposite direction as the first drive shaft 27*a*.

The invention claimed is:

1. An outboard motor comprising an engine, a crankshaft, a first propeller, a second propeller and a power transmission device with a power transfer device, a gearbox, a first drive shaft, a second drive shaft, a first endless loop flexible drive coupling, a second endless loop flexible drive coupling, a first propeller shaft and a second propeller shaft, wherein the first propeller shaft is connected to the first drive shaft through the first endless loop flexible drive coupling to rotate the first propeller shaft in a first direction, and wherein the second propeller shaft is connected to the second drive shaft through the second endless loop flexible drive coupling to rotate the second propeller shaft in a second direction opposite to the first direction, wherein the power transfer device comprises a toothed belt, wherein the gearbox includes a transmission drive shaft, wherein the crankshaft is parallel to the transmission drive shaft and is connected to the transmission drive shaft through the power transfer device for transferring output power from the crankshaft to the transmission drive shaft, so that output power from the crankshaft is transferred to the first and second propeller shafts through the power transfer device, the gearbox, the first and second drive shafts and the first and second endless loop flexible drive couplings, and wherein the gearbox comprises forward and reverse gears, so that the first and second drive shafts are reversibly operable via power from the crankshaft in forward gear and in reverse gear.

2. The outboard motor of claim 1, wherein the first propeller shaft is arranged concentric with the second propeller shaft.

3. The outboard motor of claim 1, wherein the first and second endless loop flexible drive couplings are arranged as toothed belts.

4. The outboard motor of claim 1, wherein the second drive shaft is arranged in parallel to the first drive shaft.

5. The outboard motor of claim 1, wherein the crankshaft and the drive shafts are arranged in parallel to each other and to the propeller shafts, and wherein the crankshaft, the drive shafts and the propeller shafts are arranged in a fixed configuration in relation to each other.

6. The outboard motor of claim 1, wherein the first and second endless loop flexible drive couplings are arranged below the engine when the outboard motor is operated.

7. The outboard motor of claim 1, wherein the drive shafts and the propeller shafts are arranged in a common vertical plane when said outboard motor is operated.

8. The outboard motor of claim 1, wherein the first and second propeller shafts are arranged to be below the hull of a watercraft when said outboard motor is operated.

9. A watercraft comprising a hull and an outboard motor according to claim 1, wherein the first and second propeller shafts are arranged substantially horizontal and below the hull of the watercraft when said outboard motor is operated for propulsion of the watercraft.

10. A method for power transmission of an outboard motor, comprising the steps of a) transferring rotational power from an engine crankshaft to a transmission drive shaft through a power transfer device comprising a toothed belt, and from the transmission drive shaft to a gearbox, b) transferring rotational power from the gearbox to a first drive shaft, c) transferring rotational power from the gearbox to a second drive shaft, d) by way of the gearbox, reversibly rotating the first drive shaft in a first direction and the second drive shaft in a second direction opposite to the first direction, e) transferring the rotational power from the first drive shaft to a first propeller shaft through a first endless loop flexible drive coupling, f) transferring the rotational power from the second drive shaft to a second propeller shaft, arranged concentric with the first propeller shaft, through a second endless loop flexible drive coupling, and thereby rotate the first and second propeller shafts in opposite directions.

* * * * *